US007036704B2

(12) United States Patent
Nayrac et al.

(10) Patent No.: US 7,036,704 B2
(45) Date of Patent: May 2, 2006

(54) GAS-OPERATED APPARATUS WITH COMBUSTION CHAMBER

(75) Inventors: Frédéric Nayrac, Bourg les Valence (FR); Bruno Toulouse, Valence (FR)

(73) Assignee: Societe Prospection et d'Inventions Techniques SPIT, Bourg-les-Valence (FR)

( * ) Notice: Subject to any disclaimer, the term of this patent is extended or adjusted under 35 U.S.C. 154(b) by 0 days.

(21) Appl. No.: 10/857,453

(22) Filed: Jun. 1, 2004

(65) Prior Publication Data

US 2005/0001003 A1 Jan. 6, 2005

(30) Foreign Application Priority Data

Jun. 2, 2003 (FR) ..... 03 06625

(51) Int. Cl.
*B25C 1/14* (2006.01)

(52) U.S. Cl. ..... 227/10; 227/130

(58) Field of Classification Search ..... 227/8, 227/10, 130; 123/46 SC
See application file for complete search history.

(56) References Cited

U.S. PATENT DOCUMENTS

| | | | | |
|---|---|---|---|---|
| 4,403,722 | A * | 9/1983 | Nikolich | 227/8 |
| 4,483,474 | A * | 11/1984 | Nikolich | 227/8 |
| 5,558,264 | A * | 9/1996 | Weinstein | 227/10 |
| 5,680,980 | A * | 10/1997 | Robinson | 227/10 |
| 5,687,899 | A * | 11/1997 | Dohi et al. | 227/10 |
| 6,138,887 | A * | 10/2000 | Nayrac et al. | 227/8 |
| 6,164,510 | A * | 12/2000 | Deieso et al. | 227/130 |
| 6,695,195 | B1 * | 2/2004 | Nishikawa et al. | 227/10 |
| 6,786,378 | B1 * | 9/2004 | Wagdy et al. | 227/9 |
| 2003/0034377 | A1 | 2/2003 | Porth et al. | |

FOREIGN PATENT DOCUMENTS

EP 0 726 122 A1 8/1996

* cited by examiner

*Primary Examiner*—Scott A. Smith
(74) *Attorney, Agent, or Firm*—Lowe Hauptman & Berner, LLP

(57) ABSTRACT

The apparatus includes a casing, a cylinder head, a chamber sleeve tube to form a combustion chamber, a cylinder and a drive piston. An isolating element is mounted on the chamber sleeve tube so as, when the apparatus is opened, to isolate the space formed between the anterior part of the chamber sleeve tube and the casing from the combustion chamber. A bellows is provided for ducting the cooling and venting fresh air directly towards the chamber.

20 Claims, 2 Drawing Sheets

GAS-OPERATED APPARATUS WITH COMBUSTION CHAMBER

TECHNICAL FIELD

The invention relates to an apparatus for sealing or for piercing or for driving or for hammering in any element into a receiving material, of the nail gun, staple gun or hammer type, powered by gas.

BACKGROUND OF THE INVENTION

In such an apparatus, a piston is mounted so that it can move in a cylinder where it can be propelled, by the explosion of a mixture of air and a fuel gas injected, from a cartridge, into a combustion chamber and to drive an element, for example a fastener (a nail or an insert) or some other anchor. Apart from the bearing-against-something safety feature, that prevents any firing when the apparatus is not pressed against a receiving material, this kind of apparatus has a member, known as a cage, which, when the apparatus is pressed against something, and by way of a feeler that may be a moving insert guide, pushes a chamber sleeve tube back until it comes into abutment against the cylinder head that carries the spark plug intended to cause the explosion, so as to close the combustion chamber thus formed by this sleeve tube, the cylinder head and the crown of the piston. The cage and the sleeve tube may be connected to one another by screwing. Furthermore, the retreat of the cage is performed against the action of a return spring, to return the apparatus to the open position, also bearing against the piston cylinder.

When the apparatus is in the closed position, the combustion chamber is sealed, at the rear, by an O-ring seal between the cylinder head and the chamber sleeve tube and, at the front, by another O-ring seal between the piston cylinder and the chamber sleeve tube.

In the open position, after firing, the apparatus is vented and cooled by drawing fresh air in from the rear and, when there is a fan in the chamber, by allowing this fan to rotate, in order to accelerate the venting.

To avoid recirculating burnt gases into the chamber during venting it is possible to mount, on the rear part of the chamber sleeve tube, a flexible annular diaphragm that isolates the annular space between the chamber sleeve tube and the casing of the apparatus from the combustion chamber.

Now, known gas-powered apparatuses, in the open and venting position, have a needless and disruptive annular space that is detrimental to the actual efficiency of the venting. This space on the whole lies between the casing, the rear part of the chamber sleeve tube and an annular peripheral portion of the cylinder head.

SUMMARY OF THE INVENTION

The invention of this application aims to eliminate this disadvantage.

To this end, the invention relates to an apparatus comprising a casing, a cylinder head, a chamber sleeve tube designed to, when the apparatus is pressed against something, form, with the cylinder head, a combustion chamber, a cylinder and a piston designed to be propelled by the explosion of a mixture of air and gas in the chamber and to drive an element, the posterior part of the casing being designed to form a cooling air intake for cooling the apparatus and venting the chamber and means being mounted on the chamber sleeve tube so as, when the apparatus is opened, to isolate the space formed between the anterior part of the chamber sleeve tube and the casing from the combustion chamber, characterized in that means are provided for ducting the cooling and venting fresh air directly towards the chamber.

The ducting means of the apparatus of the invention eliminate any needless and disruptive space.

As a preference, the ducting means comprise an annular bellows extending between the isolating means and the cylinder head, advantageously connected to the isolating means and fixed to the cylinder head, better still, of one single piece with the isolating means and fixed to an annular peripheral portion of the cylinder head.

In this case, the isolating means may comprise a flexible annular diaphragm.

However, the ducting means may also be mounted directly on the chamber sleeve tube and perform the function of isolation from the combustion chamber.

BRIEF DESCRIPTION OF THE DRAWINGS

The invention will be better understood with the aid of the following description of the preferred embodiment of the apparatus of the invention, with reference to the attached drawing, in which.

DETAILED DESCRIPTION OF THE PREFERRED EMBODIMENTS

Figure 1:
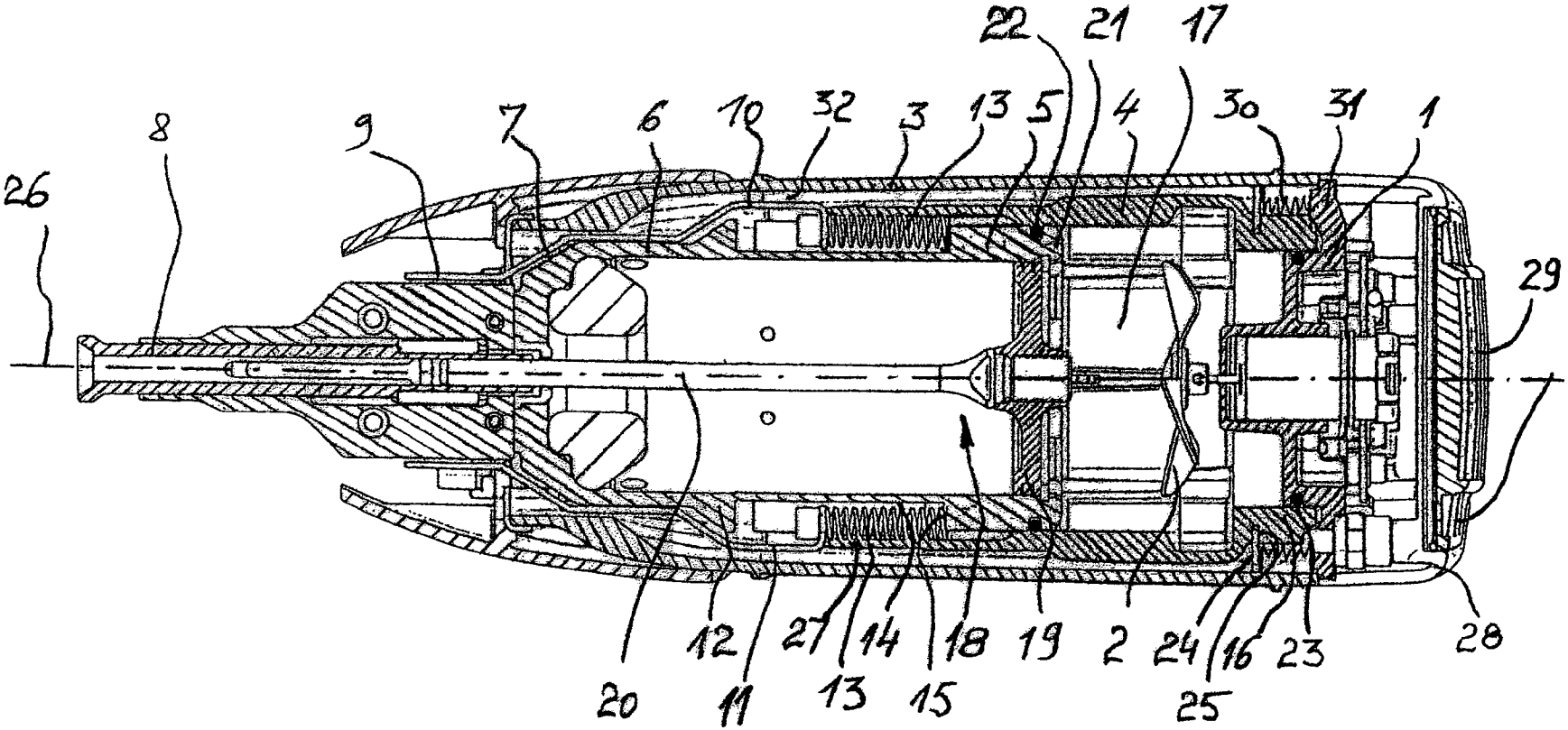
FIG. 1 is a view in axial section of the apparatus, in the closed position.

In front of a cylinder head 1, bearing a spark plug (not depicted) and a motorized fan unit 2, the handle for holding and operating the apparatus, a gas cartridge and a loader of elements (in this instance anchoring elements), the apparatus comprises, inside a casing 3, a chamber sleeve tube 4, a cylinder 5, having a front portion 6 of smaller cross section, a cage 7 for closing the chamber and a brad guide 8.

The brad guide 8, now conventional, is translationally secured to the cage, in this instance by screws, a semitubular front portion 9 of which cage envelopes the rear of the brad guide. The front portion 9 of the cage 7 is extended, towards the rear, by two lateral arms 10, 11.

The two arms 10, 11 of the cage extend along the cylinder 5, on the outside, as far as the anterior part 12 of the chamber sleeve tube 4.

Springs 13 for returning the chamber to the open position extend along the exterior wall 14 of the cylinder, these being connected to the cage 7 and butting against an annular shoulder 15 of the cylinder.

In a way that is conventional, and this is why the description will not go into full details about this point, the rear 16 of the chamber sleeve tube 4 partially forms the combustion chamber 17 of the apparatus.

Mounted in the cylinder 5 is a propulsion piston 18, with its crown 19, also partly forming the chamber 17, and its propulsion rod 20. Formed in the rear part 21 of the cylinder 5 is a groove to house a seal 22 intended, in the closed position, in conjunction with the chamber sleeve tube 4, to seal the front of the combustion chamber 17.

Also formed in the cylinder head 1 is a groove to accommodate a seal 23 intended, in the closed position, in conjunction with the rear part 16 of the chamber sleeve tube 4, to seal the rear of the combustion chamber 17.

Figure 2:
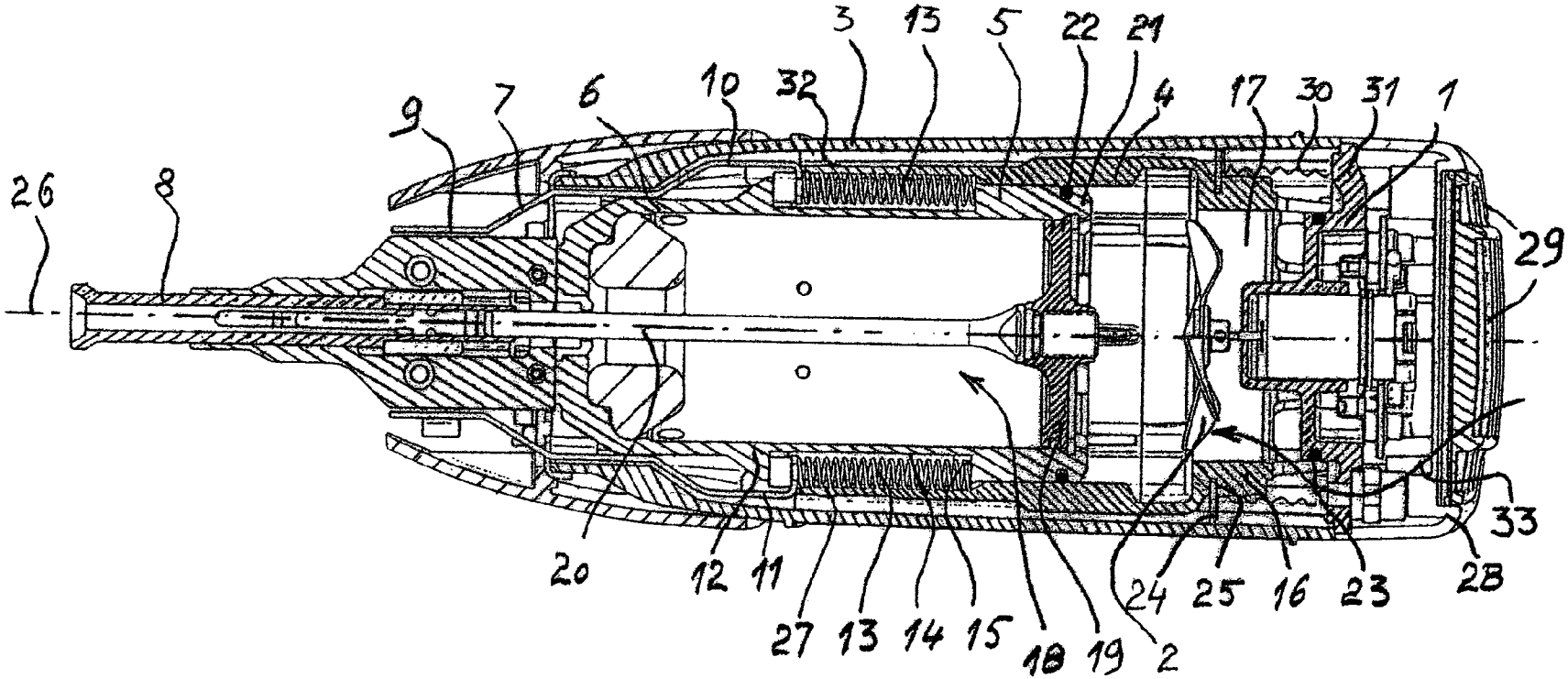
FIG. 2 is a view in axial section of the apparatus of FIG. 1, in the open position.

A flexible annular diaphragm 24, here made of elastomer, is slipped via its internal periphery into an annular groove 25 made in a transverse plane perpendicular to the axis 26 of the apparatus in the rear part 16 of the chamber sleeve tube 4. The diaphragm 24 makes it possible, when the apparatus is opened (FIG. 2), to isolate the chamber 17 from the space 32 there is between the anterior part 27 of the chamber sleeve tube 4 and the casing 3, so as to avoid the recirculation of burnt gases during venting.

The posterior part 28 of the casing 3 is pierced with intake apertures 29 for taking in fresh air for cooling the apparatus and venting the combustion chamber 17.

An annular bellows 30 that is flexible, so here made of elastomer, extends, in the same part, the isolating diaphragm 24 as far as the peripheral posterior edge 31 of the cylinder head 1 to which it is fixed, in this instance by screwing.

The bellows 30 is used, when the apparatus is opened (FIG. 2), to duct the fresh air taken in through the apertures 29 directly towards the combustion chamber 17, without any appreciable disruption to the air flow 33. The drawn-in air passes around the cylinder head 1 and, through the passage formed between the cylinder head edge 31 and the rear part 16 of the chamber sleeve tube 4, arrives directly in the chamber 17.

There has been described an apparatus with an isolating diaphragm (24) slipped into the annular groove (25) and a ducting bellows (30) extending the diaphragm (24). It would be conceivable to slip the bellows into the groove of the chamber sleeve tube and thus dispense with the diaphragm, the bellows performing both the function of isolating the chamber and the function of ducting the fresh air.

The invention claimed is:

1. A fastening apparatus, comprising:

a casing;

a cylinder head;

a chamber sleeve forming together with the cylinder head a combustion chamber upon cocking of the apparatus;

a cylinder;

a piston adapted to be propelled by an explosion of a mixture of air and gas in the combustion chamber and to drive a fastener forward;

an air inlet formed in a rear part of the casing for cooling the apparatus and venting the combustion chamber;

an isolating element mounted on the chamber sleeve so as to isolate a space formed between a front part of the chamber sleeve and the casing from the combustion chamber; and an annular bellows for directing cooling and venting air from the air inlet directly towards the combustion chamber.

2. The apparatus according to claim 1, wherein the annular bellows extends between the isolating element and the cylinder head.

3. The apparatus according to claim 1, wherein the bellows is connected to the isolating element and fixed to the cylinder head.

4. The apparatus according to claim 1, wherein the isolating element and the bellows are formed as a single piece.

5. The apparatus according to claim 1, wherein the isolating element comprises a flexible annular diaphragm.

6. The apparatus according to claim 1, wherein the bellows is fixed to an annular peripheral portion of the cylinder head.

7. A fastening apparatus, comprising:

a casing having a rear wall;

a sleeve displaceable relative to and axially of said casing between a rear position and a front position, said sleeve being moveable from the front position to the rear position upon cocking of the apparatus, said sleeve and said rear wall of the case defining together a combustion chamber when said sleeve is in the rear position;

a piston displaceable in the casing and adapted to be propelled forwardly by combustion of a combustible material in the combustion chamber and to drive a fastener forward;

an air inlet formed in the rear wall of the casing for venting the combustion chamber when said sleeve is in the front position, said air inlet being isolated from the combustion chamber by a rear portion of said sleeve when said sleeve is in the rear position; and a guiding element deformable axially of said casing, extending between said rear wall and the rear portion of said sleeve, and defining a venting air path from said air inlet to the combustion chamber when said sleeve is in the front position.

8. The apparatus of claim 7, wherein said guiding element isolates a space between a front portion of said sleeve and said casing from said combustion chamber and said venting air path.

9. The apparatus of claim 7, wherein said guiding element is expandable and contracted axially of said casing, said guiding element having an expanded state when said sleeve is in the front position and a contracted state when said sleeve is in the rear position.

10. The apparatus of claim 9, wherein said guiding element comprises a bellows.

11. The apparatus of claim 9, wherein said casing has a side wall portion adjacent said rear wall, and said guiding element isolates the side wall portion from said venting air path.

12. The apparatus of claim 9, wherein the rear portion of said sleeve is engageable with a first portion of said rear wall when said sleeve is in the rear position, the guiding element is attached to a second portion of said rear wall, and said air inlet is positioned between said first and second portions of said rear wall.

13. The apparatus of claim 7, wherein the rear portion of said sleeve is engageable with a first portion of said rear wall when said sleeve is in the rear position, the guiding element is attached to a second portion of said rear wall, and said air inlet is positioned between said first and second portions of said rear wall.

14. The apparatus of claim 13, further comprising a transverse sealing element between the sleeve and the casing, wherein said transverse sealing element isolates a space between a front portion of said sleeve and said casing from said guiding element, and hence, from said combustion chamber.

15. The apparatus of claim 7, further comprising a transverse sealing element between the sleeve and the casing, wherein said transverse sealing element isolates a space between a front portion of said sleeve and said casing from said combustion chamber.

16. The apparatus of claim 15, wherein said transverse sealing element isolates said space between the front portion of said sleeve and said casing from said guiding element.

17. The apparatus of claim 15, wherein said transverse sealing element is housed in a groove formed in said sleeve between the rear and front portions thereof, and said guiding element extends rearwardly from said transverse sealing element to said rear wall of said casing.

18. The apparatus of claim 17, wherein said transverse sealing element and said guiding element are integrally formed as a single piece.

19. The apparatus of claim 18, wherein said transverse sealing element comprises a flexible annular diaphragm and said guiding element comprises an annular bellows.

20. The apparatus of claim 15, wherein said transverse sealing element comprises a diaphragm and said guiding element comprises a bellows.

* * * * *